US005197826A

United States Patent [19]

Korloo

[11] Patent Number: 5,197,826

[45] Date of Patent: Mar. 30, 1993

[54] OFFSHORE GAS FLARE SYSTEM

[75] Inventor: Jafar Korloo, Moorepark, Calif.

[73] Assignee: Imodco, Inc., Calabasas Hills, Calif.

[21] Appl. No.: 964,666

[22] Filed: Oct. 22, 1992

[51] Int. Cl.[5] ..... E02B 17/00; B63B 22/20

[52] U.S. Cl. ..... 405/224; 405/195.1; 405/202; 441/23; 441/29

[58] Field of Search ..... 405/169, 171, 195.1, 405/202, 203, 205, 207, 224, 224.2; 166/350, 364, 367; 431/202; 441/1, 3, 21, 23, 28, 29

[56] References Cited

U.S. PATENT DOCUMENTS

| | | | |
|---|---|---|---|
| 2,894,269 | 5/1956 | Dodge . | |
| 3,372,410 | 7/1966 | Hindman . | |
| 3,503,443 | 4/1962 | Blanding . | |
| 3,902,843 | 9/1975 | Genini . | |
| 4,065,822 | 1/1978 | Wilbourn . | |
| 4,127,003 | 11/1978 | Vilain | 405/202 |
| 4,227,830 | 10/1980 | Tuson | 405/195.1 |
| 4,268,245 | 5/1981 | Straitz . | |
| 4,371,037 | 2/1983 | Arnaudeau . | |
| 4,666,339 | 5/1987 | Pollack | 405/224 X |
| 4,768,984 | 9/1988 | de Oliveira . | |
| 4,797,033 | 1/1989 | Pollack | 405/224 X |

*Primary Examiner*—David H. Corbin

*Attorney, Agent, or Firm*—Art Freilich; Robert D. Hornbaker; Leon D. Rosen

[57] ABSTRACT

Apparatus is described for flaring large amounts of natural gas at a location spaced from an offshore production platform. The apparatus includes a spar buoy structure (32, FIG. 1) anchored at a location on the order of 0.1 kilometer from the platform (12) and coupled through an undersea conduit (44) to the platform. The structure is anchored by catenary chains (71–74), and has a ballasted lower portion and a buoyant upper portion to keep the structure upright so the flare (42) always remains high above sea level. The undersea conduit (44) which carries natural gas to the structure, connects to a buoy pipe (66) that extends along the structure, at a location (64) close to the center of gravity (80) of the structure, or at the bottom (keel) of the buoy, to minimize failure from constant structure pivoting. A wide lower part (34) of the structure includes several individually-sealed air-filled chambers (91–98, FIG. 2) spaced along its height. A mechanism (100, FIG. 4) coupled to one of the chambers varies the amount of gas and water therein to vary the buoyancy of the structure. A water pump (132, FIG. 5) in the spar structure can pump water to hose stations (161–164, FIG. 6) on the platform, to assure the availability of water for fighting a fire that might destroy pumps on the platform.

14 Claims, 3 Drawing Sheets

OFFSHORE GAS FLARE SYSTEM

BACKGROUND OF THE INVENTION

Offshore production platforms often produce very large amounts of natural gas along with liquid hydrocarbons. In many cases, the amount of natural gas produced is so large that it cannot be flared from a location on the platform because of the great amount of heat produced. Instead, a flaring structure is set up at a distance away from the platform and connected to the platform by an undersea conduit, to flare the gas. However, care must be taken that the flaring structure and anchoring structure therefor do not break up even in very large storms. Also, that motions of the flaring structure are minimized so its top is always above the splash zone, so the part of the structure above sea level does not break, and so hoses carrying gas to the lower part of the structure are not highly tensioned. These requirements must be met while still minimizing the cost of the flaring structure and maximizing its trouble-free life. An apparatus for flaring large amounts of gas at a distance from a production platform, which could be constructed economically and yet remain reliably intact over a long lifetime and even in very heavy storms, would be of considerable value.

SUMMARY OF THE INVENTION

In accordance with one embodiment of the present invention, an apparatus is provided for flaring large amounts of natural gas at a location spaced from, but in the vicinity, of an offshore production platform. The apparatus includes a spar buoy structure with a lower part lying under the sea surface, a middle part that extends up through the sea surface, and a top flare device that extends up to a flare lying high above the sea surface. A buoy pipe extends from a location along the lower part to the flare to carry gas thereto, while an undersea gas conduit extends from the platform to a location along the structure where it connects to the buoy pipe. The structure is anchored by catenary chains and/or wire ropes, with a bottom portion of the structure being ballasted and an upper portion being buoyant to keep the structure upright while floating above the seafloor.

The undersea gas conduit connects to the buoy pipe at a location close to the center of gravity of the structure (or to the buoy keel for structures used in deep seas), to minimize fatigue resulting from continual pivoting of the structure. The catenary chains are attached to the structure at a location high above the center of gravity, to assure large chain movement and consequent large damping of structure pivoting. The lower part of the structure contains a plurality of separate water-tight chambers, to keep the structure afloat in the event of accidental flooding of one of the chambers. One of the chambers has means for varying the amount of water ballast therein (versus air), to adjust the float level of the structure. One of the chambers contains an engine and water pump, which can pump water along an undersea water conduit that extends parallel to the gas conduit, and which extends to a plurality of fire fighting stations on the platform.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
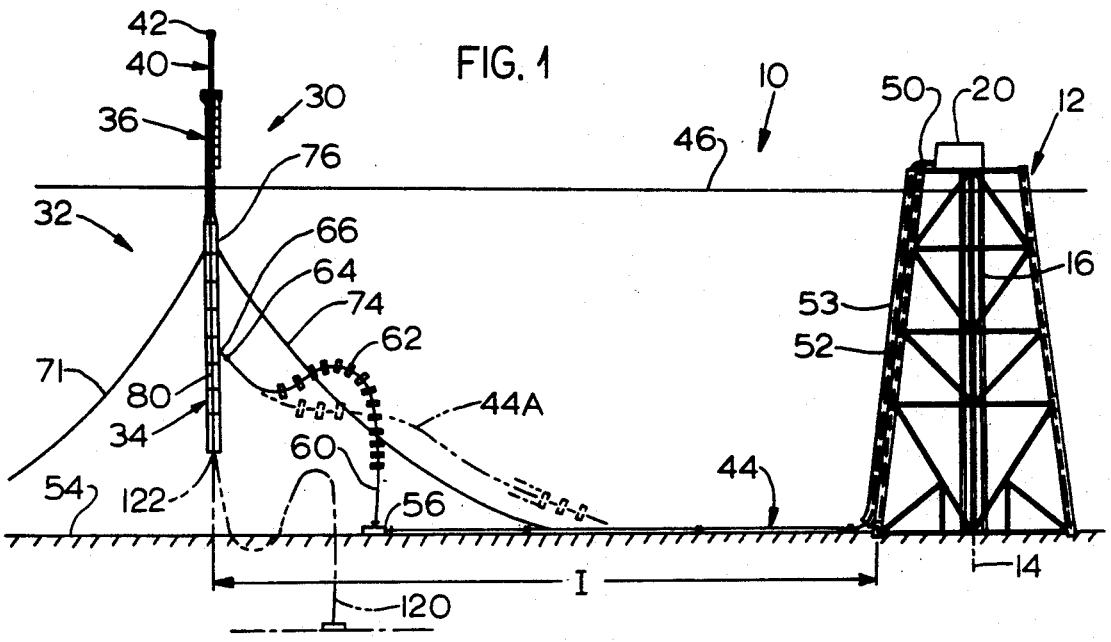
FIG. 1 is a side elevation view of an offshore hydrocarbon production and gas flare system constructed in accordance with the present invention.

FIG. 1 illustrates an offshore production system 10 which includes an offshore production platform 12 that is being used to produce hydrocarbons from an undersea well 14. The hydrocarbon pass up through a group of pipes 16 to a separator 20 where natural gas, sand, etc. is separated from liquid hydrocarbons. The natural gas is not economical to transport, and is flared. However, where very large amounts of natural gas are produced, the great heat resulting from flaring requires that the flare lie a considerable distance from the platform, such as on the order of about 0.1 kilometer from the platform.

Figure 3:
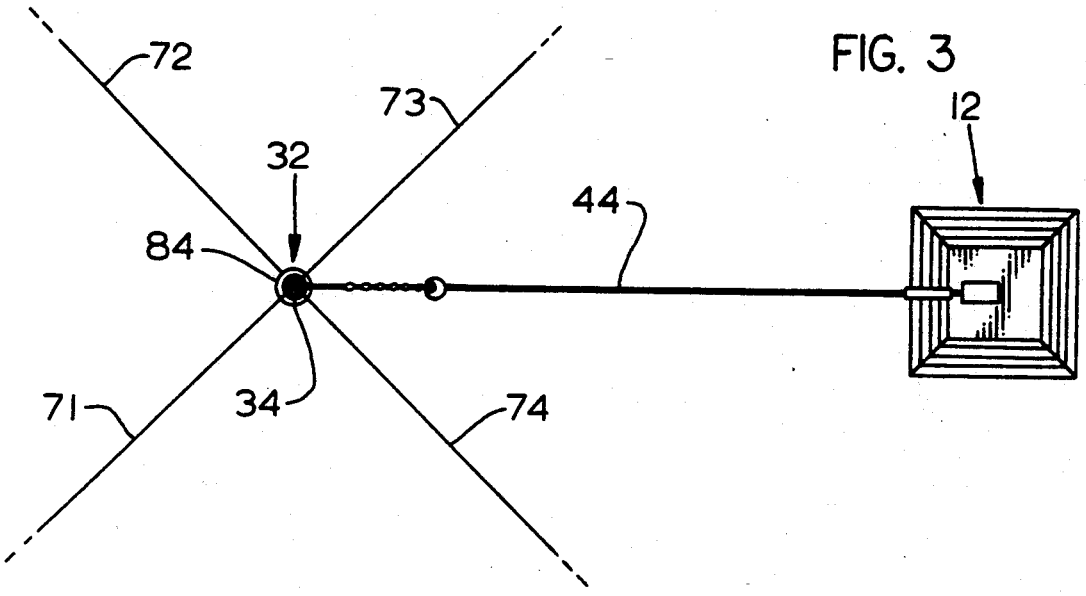
FIG. 3 is a plan view of the system of FIG. 1.

A flaring apparatus 30 is provided for flaring the large amounts of natural gas produced by the platform 12. The apparatus 30 includes a spar buoy structure 32 which has a lower part 34 in the form of an elongated cylinder, a middle part 36 in the form of a thinner elongated cylinder, and a top flare device 40 in the form of a cylindrical pipe which carries a gas flare 42 at its top. An undersea conduit 44, which lies primarily under the sea surface 46, has one end 50 connected to the separator 20 to carry away natural gas therefrom. The conduit 44 includes a downwardly-extending portion 52 that extends within a larger thin-walled pipe 53 along the height of the platform, to the level of the seafloor 54. Much of the conduit extends along the seafloor to a base 56 located near the spar buoy structure 32. A final part 60 of the undersea conduit extends upwardly from the base 56, and is supported by bead floats 62. The conduit part 60 connects at a connection location 64 to a buoy pipe 66 which extends upwardly within much of the height of the buoy structure. The spar buoy structure is held in position by a group of catenary chain devices 71–74 (FIG. 3) whose upper ends connect to an underwater position 76 along the buoy structure. The chain devices 71–74 may be chains, or wire ropes and chains, or other long and flexible devices which can withstand high tension loads, all of which are referred to herein as "chain devices".

Figure 2:
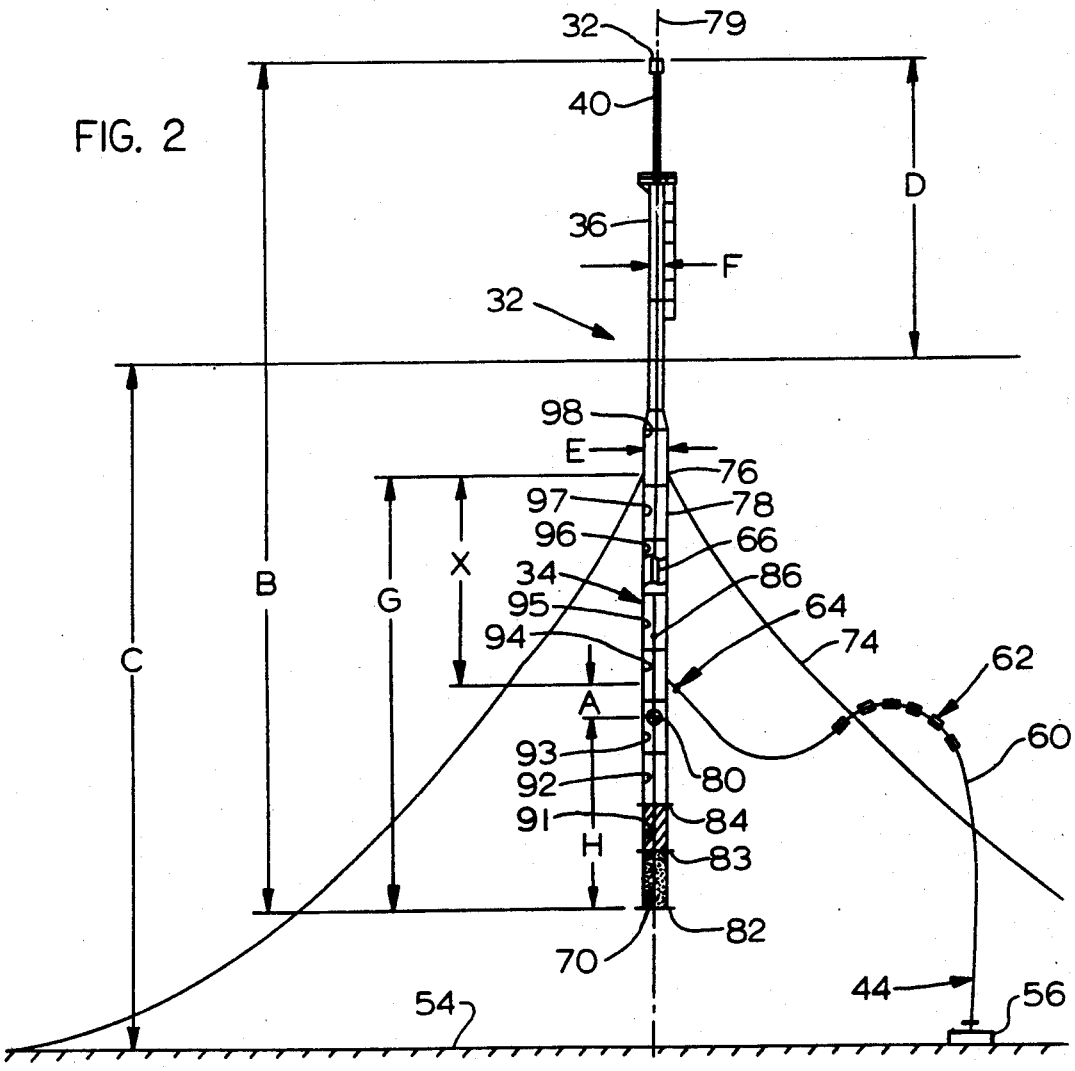
FIG. 2 is a side view of a portion of the system of FIG. 1.

As shown in FIG. 2, the structure lower part 34 floats above the seafloor 54 while being limited in its horizontal and vertical movement by the catenary chain devices 71–74. The structure lower part has a bottom chamber or portion 70 that is ballasted, as by filling it with concrete, iron ore, or other high density material. The structure has an upper portion 78 which is buoyant as by filling it with air. This positions the spar buoy structure so its axis 79 remains substantially vertical. Of course, the buoyancy of the upper portion 78 is much greater than the ballast 70, so the spar buoy structure can support considerable weight of the chain devices 71–74, as well as the weight of the portion of the structure lying above the sea surface.

The spar buoy structure 32 has a center of gravity at 80 which lies deep under the sea surface. The center of gravity at 80 lies above the keel 122 by about one-third the underwater height of the buoy. Sideward forces applied to the structure, especially waves and currents, tend to cause movement and pivoting of the structure, with the motion being least substantially at the center of gravity. That is, spar buoy locations substantially at the center of gravity, undergo less motion than other locations on the spar buoy. Applicant positions the connection location 64, where the final part 60 of the undersea conduit 44 connects to the bottom of the buoy pipe 66, so it is located close to the center of gravity of the spar buoy structure at 80, and below the center of buoyancy at 86. As a result, as the spar buoy structure 32 repeatedly moves and tilts under the forces of current, wind, and waves, movement of the connection location 64 is minimal. This minimizes fatigue stresses and therefore fatigue failure of the upper portion of the final part 60 of the underwater conduit, and of the lower part of the buoy pipe at its connection flange at connection location 64.

The required length of the final part 60 of the undersea conduit, which is flexible and therefore expensive, depends to some extent upon how far the connection location 64 will move in a severe storm. By positioning the connection location near where movement is minimal, the required length of flexible pipe or hose at 60 is minimized. The distance A between the center of gravity and the connection location is preferably less than one tenth the overall height B of the spar buoy structure, and preferably less than 5% (preferably less than 2%) of the overall height.

The catenary chain device 71–74 which limits horizontal excursions of the spar buoy structure, also minimize pivoting of it. The great length of the several chain devices results in great resistance to them being pulled (primarily horizontally) through the water. Applicant attaches the chains to the structure at locations 76 that are spaced a considerable height X above the center of gravity 80. As a result, applicant uses the damping of the chains that resists horizontal movement, to provide maximum damping against pivoting of the structure.

The distance X between the center of gravity at 80 and the chain attachment locations 76, is at least about 15% of the overall height B of the spar buoy structure to obtain considerable damping in pivoting. By locating the chain attachment locations near the sea surface, the larger forces applied by currents near the sea surface, are transferred by the structure to the chain devices near the location where the forces are applied to the structure. However, a certain minimum underwater depth of the chain attachment locations 76 is generally required by regulations, and to avoid interference with vessels servicing the structure.

It is important that natural, or resonant, periods of oscillation of the spar buoy structure, be considerably different from the periods of waves or swells. Such difference is important to prevent resonance, which can lead to very large movement of the structure. The periods of waves and swells is generally about eight to fourteen seconds (a frequency of about 0.09 second). The natural period of tilt of the structure from the Vertical (pitch and roll) is about 60 seconds, which is far larger than a wave or swell period. However, the natural period of heave (up and down motion) is about 20 seconds, which is close enough to wave periods to be undesirable. Thus it is important to minimize the amount of heave.

Applicant decreases the amount of heave (while increasing the natural frequency of heave), in a number of ways. The middle part 36 of the spar buoy structure, which extends at least a few meters above and below the sea level (for a quiescent sea), is of smaller diameter than the lower part 34. This results in minimum change in submersed volume of the structure for a wave of given height, to minimize heave. Applicant adds damping rings 82–85 to the lower part of the structure, below the center of gravity at 80, to increase the amount of displaced water in heave motion, and to increase drag, or resistance, to heave and increase the structure natural frequency in heave. The damping rings preferably have a diameter no more than about one and one-third the diameter of the lower structure part, to limit the forces that they apply to the structure.

It is desirable to maximize the natural period of the spar buoy structure in tilt. One way to control the tilt natural period, is to vary the distance between the center of gravity at 80 and the center of buoyancy at 86. This is because when the buoy tilts, the downward face centered at 80 pulls that location down while the upward force at 86 pulls that location up, to restore the structure to the vertical orientation. By weighting the lowermost chamber 70, applicant lowers the center of gravity. As mentioned above, the long length of chains that are dragged through the water when the buoy tilts, also minimizes tilt.

The lower part 34 of the structure is formed with several air-filled chambers 91–98 that are spaced from each other along the height of the buoy structure. Each chamber 91–98 is sealed from the other chambers, so that in the event of leakage of one of the chambers, the rest of the chambers can still maintain the structure with the bottom portion 90 above the seafloor and the flare 32 far above the sea surface.

Figure 4:
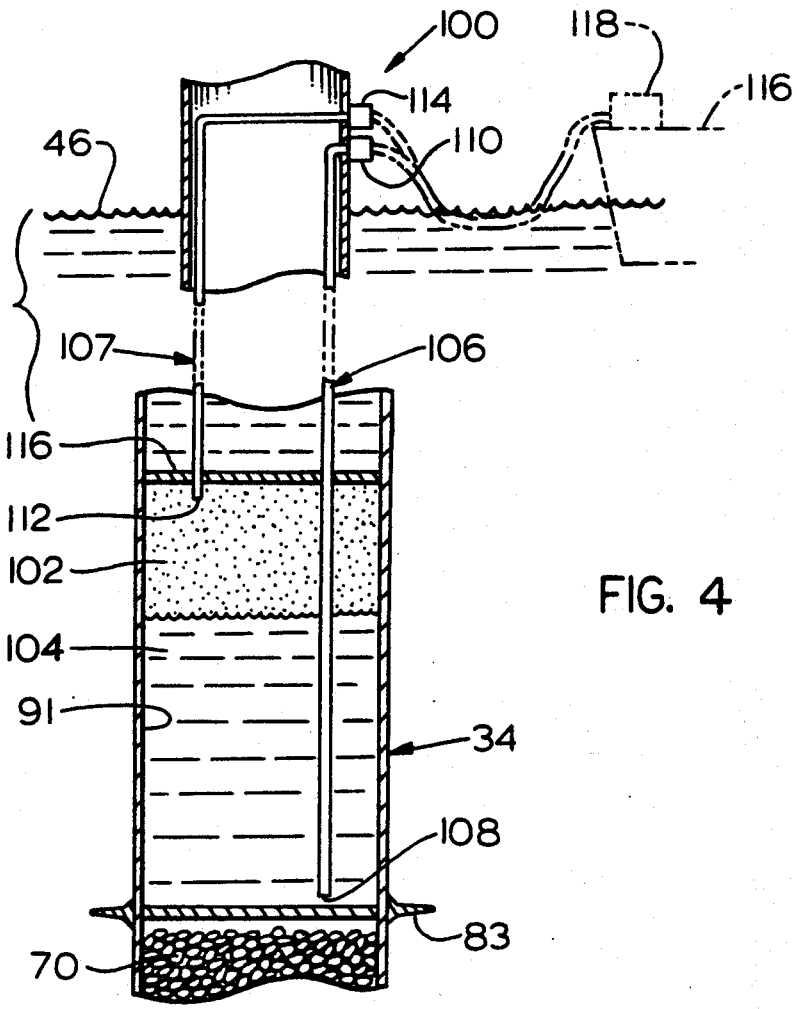
FIG. 4 is a sectional view of a portion of the spar buoy structure of FIG. 2.

As shown in FIG. 4, the spar buoy structure includes a mechanism 100 that enables changing the amount of gas 102 and water 104 in one of the chambers 91, this being the lowermost of the chambers. The particular mechanism 100 includes water and air pipes 106, 107 extending from the chamber 91 to near the sea surface. The water pipe 106 has a lower end 108 open to the bottom of chamber 91 and an upper end connected to a fluid coupling 110 lying near the sea surface 46. The air pipe 107 has a lower end 112 open to the top of the chamber 91, and an upper end connected to another fluid coupling 114. When the buoyancy of the structure is to be changed, a vessel 116 is brought to the couplings 110,114. To increase ballast, the vessel allows pressured air in the upper part of the chamber 91 to escape through the air pipe 107, and pumps water into the chamber from a pump device 118 into the water pipe 106. To increase buoyancy, the vessel passes pressured air from the pump device 118 through the air pipe 107. The increased air pressure in chamber 91 forces water to exit the chamber through water pipe 107. Of course, gas such as Nitrogen can be used instead of air, and applicant uses the term "air" to include gas which is used only for its pressure effects. Also, liquids other than water can be used. It is also possible to allow water to enter and exit the chamber 91 directly into the surrounding sea rather than to carry it to or from the surface. It is noted that access to the chambers can be accommodated by providing a water tight hatch (not shown) in each separator wall 116 that separates adjacent chambers.

In a flaring apparatus that applicant has designed, for use in a region having a sea depth C (FIG. 2) of 65 meters, the spar buoy structure had an overall length B of 82 meters, with the flare 32 lying a distance D of 30 meters above the sea surface and the bottom of the spar buoy lying a distance of 13 meters above the seafloor. The lower part 34 of the structure had a diameter E of 2.25 meters, while the middle part 36 had a diameter F of 1.6 meters. The buoy pipe had a diameter of 18 inches. The smaller diameter F of the structure middle part is desirable to minimize forces on the upper part of the structure arising from winds, waves, and currents near the sea surface. The diameter F should be no more than one-quarter the significant wave height (the average of the highest waves (that is, the highest one-third of the waves) in the most severe storm encountered in that region. The average width of the structure, of about 2 meters, is much less than 5% of the height B of the structure. The position 76 where the chain devices were attached, was located a distance G of 42 meters above the bottom of the structure, and a distance X of 21 meters above the center of gravity. The center of gravity 80 lay a distance H of 20 meters above the bottom of the structure. The structure lay a distance I (FIG. 1) of 150 meters from the platform. The final part 60 of the conduit is a flexible hose of a length of about 50 meters.

While FIG. 1 shows a base 56 at the seafloor where the final part 60 of the undersea conduit attaches, it is also possible to extend the undersea conduit as indicated at 44A, wherein part of it lies on the seafloor and extends in a largely catenary curve while supported by floats, to where it attaches to the spar buoy structure. In deep water, as at depths of more than about one or two hundred meters, it is also possible to extend the underwater conduit so it does not reach the seafloor but is supported above it by buoys. However, in moderately deep water, of a depth of over about 70 meters but not more than about 150 meters, applicant prefers to use a flexible conduit, as shown at 120 in FIG. 1, which connects to the keel 122 of the flare structure. This minimizes length of flexible conduit. The currents at great depths are smaller than near the surface, so the keel of a structure that extends deep underwater experiences only moderate forces and motions.

Fire is a constant danger at offshore production platforms. At least one water pump station is provided on the platform, which includes an engine, a fuel storage tank for the engine, a pump, and a hose. However, it is possible for a fire to prevent access to the water pump station. The provision of many water pump stations around the platform can be undesirable because of the space and expense for several complete stations and the additional danger of the fuel storage tank at each station.

Figure 5:
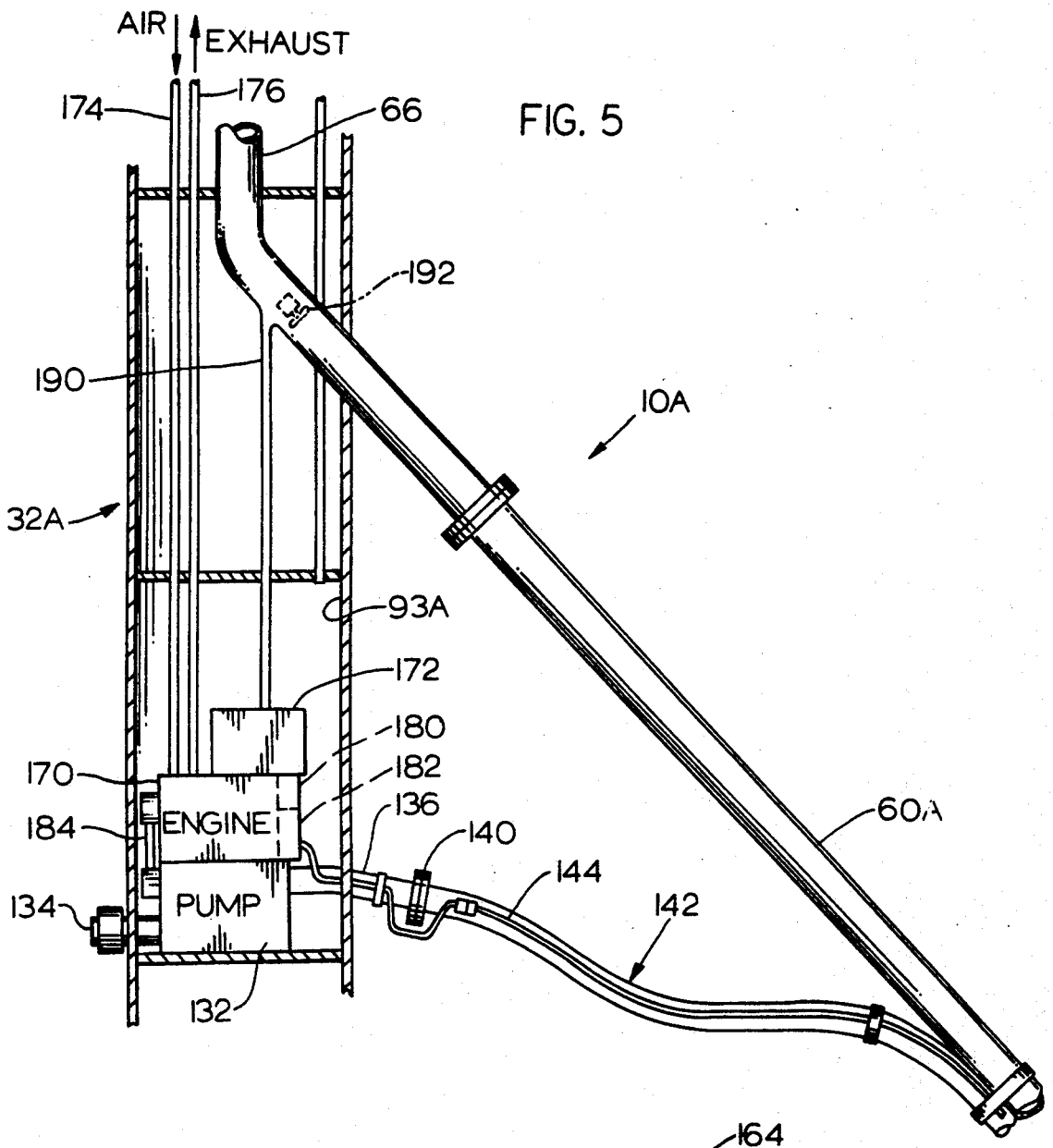
FIG. 5 is a side view of a portion of a system constructed in accordance with another embodiment of the invention.

FIG. 5 illustrates an offshore production system 10A which is similar to that of FIGS. 1–4. However, the spar buoy structure 32A includes a water pump 132 lying in the compartment 93A of the buoy structure. The pump 132 takes in water through an inlet 134 and pumps it out through an outlet 136 that extends to a water conduit connection location 140. A water conduit device or conduit 142 extends from the connection location and parallel and adjacent to the gas conduit 60A to the platform. The water conduit can be a separate hose or flexible pipe, or can be part of a large multipassage conduit that includes the gas conduit. An electrical cable 144 extends parallel to the water conduit.

Figure 6:
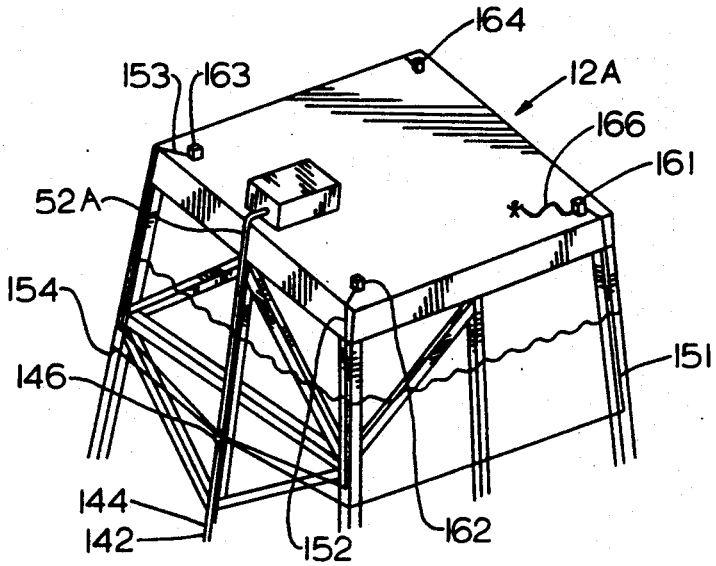
FIG. 6 is a partial simplified isometric view of the system of FIG. 5.

As shown in FIG. 6, the water conduit 142 extends partway along the downwardly-extending portion 52A of the gas conduit, to an underwater water manifold 146 mounted on the platform 12A. Four water lines 151–154 extend from the manifold to four hose stations 161–164 spaced about the platform. Although the top of the platform is typically congested with equipment, such congestion is not shown in FIG. 6. Each hose station includes a valve that can be opened to allow water to pass through a hose 166 to fight a fire. Each station also includes a control that can be operated to send a signal through a wire leading to the electrical cable 144 to control apparatus that drives the pump in the spar buoy structure. A sensing circuit at the water manifold 146 can sense when water is pouring out of one damaged water line 151–154 to close a valve along that line.

As shown in FIG. 5, the pump 132 is driven by a motor such as an internal combustion engine 170 that receives fuel from a tank 172. The engine receives air from an air tube 174 and expels exhaust through an exhaust tube 176 (possibly through an exhaust pump). Both tubes extend up through the spar structure and open to the atmosphere. Signals received through the electrical cable 144 allow an electrical storage battery 180 to energize a starter 182 that starts the engine, to begin the pumping of water. The engine 170 can be sealed against the entrance of water, and can be connected to the pump through a sealed shaft 184.

The motor 170 can be powered by the flow of natural gas passing through the buoy pipe 66, instead of by stored liquid fuel. In one system this is accomplished by a conduit 190 that connects the buoy pipe to the motor and carries natural gas to the motor to energize it as where the motor is an internal combustion engine. The motor 170 can be an electric motor which is powered by a large storage battery at 180. The storage battery is maintained fully charged by a small turbine 192 lying along the buoy pipe, whose output is delivered along conduit 190 to the battery, to thereby energize the motor by the flowing gas. The difference in temperature of sea water and of the flared gas in pipe 66, can be used as with a thermopile, to keep the storage battery charged.

Thus, the invention provides apparatus useful with an offshore production platform for flaring gas at a distance from the platform. The apparatus includes a spar buoy structure held in place by catenary chain devices, having a bottom portion that is ballasted and an upper underwater portion that is buoyant, and having a flare held far above the sea surface. An underwater conduit is connected to the structure at a location near the center of gravity of the structure to minimize fatigue on the parts. The catenary chain devices are preferably attached at an underwater location spaced far from the center of gravity to damp pivoting of the structure. The wider lower part of the structure has a plurality of gas-filled chambers which are independently sealed from each other, to support the structure even in the event of flooding of one of the chambers. Means are coupled to the lowermost of the chambers to adjust the amount of gas and water therein, to enable adjustment of the buoyancy of the structure. A water pump and driving motor can lie in the spar buoy structure, to pump water to one or more hose stations on the platform.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. Apparatus useful with an offshore production platform which lies in a sea and produces hydrocarbons from at least one well extending into the sea floor, for flaring a natural gas component of the produced hydrocarbon, comprising:

a spar buoy structure which has a substantially vertical axis and includes a lower part which lies under the sea surface but floats above the seafloor, a middle part that extends up from the lower part and through the sea surface, and a top flare device that extends up from the middle part and that has a flare at the top, said structure having a buoy pipe extending from a location along said lower part and up to said flare to carry gas therealong;

an undersea conduit extending from said platform to said location along said structure lower part and connected to said buoy pipe at said location, for carrying gas thereto;

said structure lower part floats above the seafloor, and said lower part has a bottom portion that is ballasted and an upper portion that is buoyant to keep said structure upright wherein said axis is substantially vertical;

a plurality of catenary chain devices extending in catenary curves from an underwater location on said structure to the seafloor.

2. The apparatus described in claim 1 wherein:

said spar buoy structure has a center of gravity lying at a position along said lower part, and said location to which said undersea conduit connects lies no further from said center of gravity than one tenth the total height of said spar buoy structure.

3. The apparatus described in claim 1 wherein:

said sea has a depth of at least 70 meters at the location of said spar buoy structure, said spar buoy structure has a keel at the bottom of said lower part, and said location to which said undersea conduit connect lies at said keel.

4. The apparatus described in claim 1 wherein:

said spar buoy structure has a center of gravity lying at a position along said lower part;

said underwater location from which said chain devices extend from said structure, lies a distance from said center of gravity which is at least 15% of the total height of said spar buoy structure.

5. The apparatus described in claim 1 wherein:

said structure has a center of buoyancy lying above said center of gravity, and said location to which said undersea conduit connects, lies between said center of buoyancy and said center of gravity.

6. The apparatus described in claim 1 wherein:

includes a plurality of air filled chambers spaced along its height with each chamber being individually sealed, and said spar structure is sufficiently buoyant to maintain said lower part above the sea floor even if one of said chambers is completely flooded.

7. The apparatus described in claim 1 wherein:

said lower part includes at least one sealed chamber and means for changing the amount of gas and water in said chamber.

8. The apparatus described in claim 7 wherein:

said chamber lies deep under the sea surface and said means for changing includes a pipe extending up from said chamber to a location near the sea surface to receive pressured air, and a source of pressured air that can be coupled to said pipe.

9. The apparatus described in claim 1 including:

a water pump and a motor coupled to said pump to drive it, said pump and motor lying in said spar buoy structure;

a water conduit device extending parallel and adjacent to most of the length of said undersea conduit to said platform;

at least one hose station mounted on said platform and coupled to said water conduit device to receive water therefrom, said hose station including a hose for directing water at a fire.

10. The apparatus described in claim 9 wherein:

said motor is energized by said gas flowing through said buoy pipe.

11. An offshore production system lying in a sea comprising:

an offshore platform having a lower end fixed to the seafloor and an upper end lying above the sea surface, said platform having at least one pipe that carries liquid and gaseous hydrocarbons up along the platform, and said platform having separator apparatus that separates gas from the material flowing along said pipe;

a tall spar buoy structure having an average diameter no more than 5% of its height, said structure lying a distance on the order of 0.1 kilometer from said platform, said structure having a totally underwater lower part, a middle part of smaller diameter than said lower part and extending up from said lower part through and above the sea surface, and a top flare part that extends upwardly from said middle part and that has a flare at the top, said structure having a buoy pipe extending from a location along said lower part to said flare;

an undersea conduit having a rear end extending from said separator on said platform, said conduit extending downwardly along said platform to an undersea location, and under water to said location on said middle part of said spar buoy structure where said conduit has a front end that connects to said buoy pipe, with most of the portion of said conduit extending a distance of at least the height of said structure bottom above said seafloor, being flexible;

a plurality of chain devices extending in catenary curves from locations on said buoy structure to the seafloor;

said lower part of said spar buoy structure has a bottom portion that is ballasted and an upper portion that is buoyant, to produce a center of gravity of said spar buoy structure that lies closer to said location where said conduit front end connects to said buoy pipe, than 10% of the height of said buoy structure.

12. The system described in claim 11 wherein:

said locations from which said chain devices extend, lay above said center of gravity by a distance of at least about fifteen per cent of the height of said buoy structure.

13. The system described in claim 11 wherein:

said lower part of said spar buoy structure has a plurality of water tight chambers spaced along its height, and has a mechanism that is operable to vary the amount of water in at least one of said chambers.

14. The system described in claim 11 including:

a water pump mounted in said spar buoy structure, and a motor mounted in said spar buoy structure and coupled to said water pump to drive it;

a water conduit device extending parallel and adjacent to most of the length of a said undersea conduit to said platform, said water pump being coupled to said water conduit device to deliver water thereto;

a plurality of hose stations mounted on said platform, each including a hose coupled to said water conduit, to enable a person on said platform at one of said hose stations to obtain water to pass out of said hose.

* * * * *